US005297795A

United States Patent [19]

Meikle

[11] Patent Number: 5,297,795

[45] Date of Patent: Mar. 29, 1994

[54] TARGET GREEN FOR GOLF PRACTICE

[76] Inventor: John B. Meikle, 5 Ellis Ct., Rye, N.Y. 10580

[21] Appl. No.: 943,498

[22] Filed: Sep. 11, 1992

[51] Int. Cl.[5] ..... A63B 69/36

[52] U.S. Cl. ..... 273/181 R; 273/181 A

[58] Field of Search ..... 273/181, 182, 176, 35 B, 273/32 R, 177 B

[56] References Cited

U.S. PATENT DOCUMENTS 3,156,471 11/1964 Bibeau ..... 273/182 R
3,966,212 6/1976 Mason ..... 273/181 A
3,990,708 11/1976 Ingwersen ..... 273/181 F

*Primary Examiner*—Mark S. Graham
*Attorney, Agent, or Firm*—Hopgood, Calimafde, Kalil, Blaustein & Judlowe

[57] ABSTRACT

An inflatable artificial golf green is designed for use at driving ranges. The target green structure is formed at an incline to provide users of the golf range the appearance of a much larger target surface due to the perspective effects when viewing an inclined object from a distance. The construction of the target green is sectional to facilitate transportation. The landing surface includes artificial turf and an energy absorbing pad for more realistic performance.

6 Claims, 1 Drawing Sheet

TARGET GREEN FOR GOLF PRACTICE

The present invention generally relates to structures configured to give the outward appearance of select surfaces associated with the game of golf and, more particularly, an apparatus designed and configured to give the outward appearance when viewed from a distance, of a golf green and the attendant features associated with the green structure including a pin, surrounding rough and hazards such as sand traps, etc.

The game of golf has exploded in popularity in the past 15 years, with a dramatic increase in overall use of existing golf facilities, such as public and private courses and driving ranges. As more and more individuals take up the sport of golf, there has been a corresponding saturation of existing golf courses and the resources available to teach golf to newcomers. This has had the unpleasant side effect of creating significant waiting periods for course access and time consuming use of courses by beginners.

In addition to actual play on a certified golf course, many players visit golf "driving ranges" for extra practice at their game. A golf driving range is a large open area such as a grass covered field, with a line of hitting platforms arranged along one edge of the field. These individual hitting platforms will often include a tee for hitting golf drives into the field. In this regard, the driving range is operated for profit by renting to a customer a basket of practice golf balls that are then used by the customer at the hitting platform. More particularly, the customer will tee up the practice ball and hit it into the field; this is repeated for each ball in the basket providing concentrated practice to the customer with one or more clubs that is perceived needing work.

The use of driving ranges for practice and teaching provides a useful release valve on the overcrowding of the actual golf courses. Lessons can be given at a leisurely pace without inconvenience to following groups of players. Indeed, the novice golfer can develop sufficient skill at the driving range prior to venturing out on a golf course in play.

Notwithstanding the above-noted benefits, driving ranges suffer several significant drawbacks, limiting their usefulness in several aspects. Primarily, a driving range provides no semblance of the actual golf game on a real course. Although the golf swing is unchanged, the target in a driving range is a large open field with possibly some yardage markers indicating distance from the hitting platform. The use of a golf green, i.e., the actual targets in golf, at the driving range is precluded as uneconomical or impractical for the intended purpose. Even when provided, a green is located at a significant distance from the player, inhibiting the player's ability to observe the accuracy of his shot relative to the green. Whatever the reason, the outcome is that the customer is unable to gauge the accuracy of his/her hitting as it relates to the actual game of golf during his/her session at the range.

OBJECTS AND SUMMARY OF THE PRESENT INVENTION

It is, therefore, an object of the present invention to provide an apparatus for use at a driving range to enhance the overall practice session by providing a sophisticated target to customers and practitioners at the range.

It is another object of the present invention to provide an apparatus that is configured to appear as a full scale green surface when viewed from a distance.

It is an additional object of the present invention to provide an apparatus that is made of inflatable material and constructed to create an inclined plane in the direction of the driving range user.

The above and other objects of the present invention are realized in a specifically delineated target green apparatus formed of inflated structural sections. The target green is constructed at an incline. This incline creates the illusion of a green surface of significant overall area when viewed from one hundred yards or more. The green is covered with a soft material such as artificial turf to preclude excessive bouncing when struck with golf balls. The incline would facilitate the collection of used golf balls by directing deflecting balls towards a common area for collection.

In accordance with the varying aspects of the present invention, separate structures associated with the green may be integrated with the target green. These include small traps, water and rough each portrayed at angles that accentuate their size to a viewer from a distance. A flag pin and hole is located on the surface with interconnects to register shots that end up in the hole for promotional purposes.

As well as the illusion of a larger hitting surface, the inclined target green of the present invention permits the golfer to directly observe where on the green his shot has landed. As opposed to a flat landing area, the inclined surface is easily observed from a significant distance. This feedback is especially important in refining golf shot-making proximate to the green, where accuracy is critical.

The foregoing features are more fully appreciated taken in conjunction with the following description of a specific illustrative example thereof including the following drawing.

DETAILED DESCRIPTION OF THE PRESENT INVENTION

Figure 1:
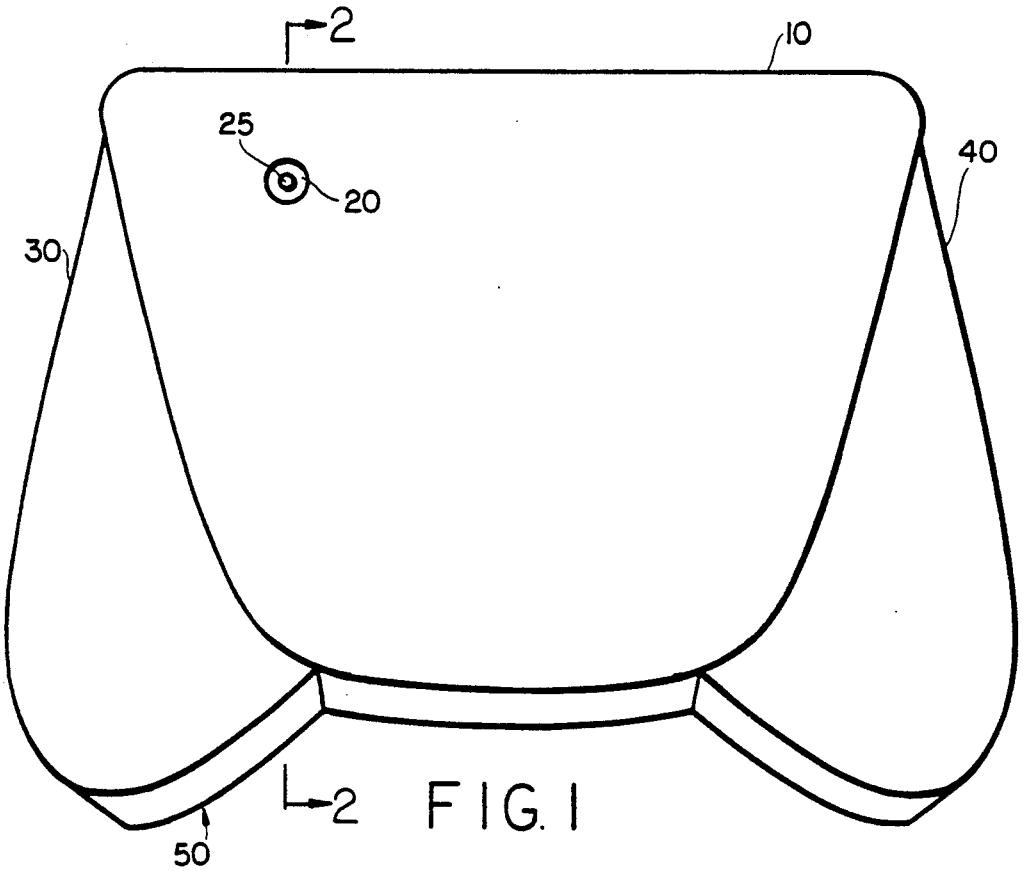
FIG. 1 depicts the inventive apparatus in both plan and cross-sectional views.
Figure 2:
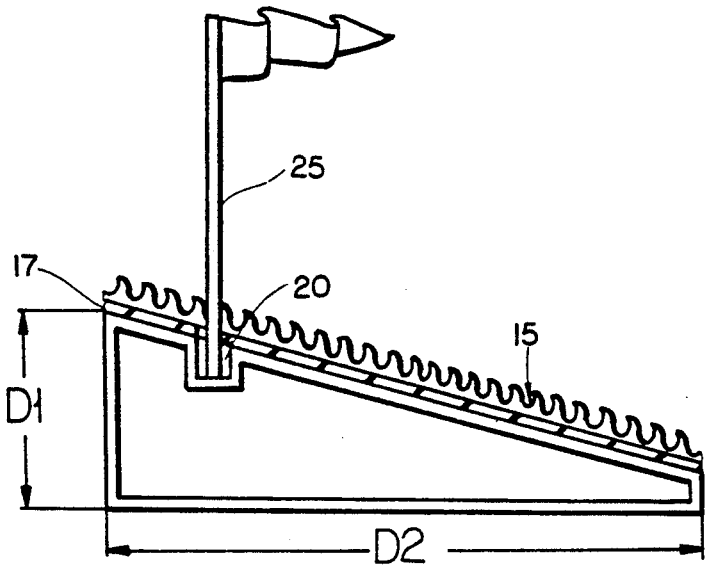

Turning now to FIG. 1, the present invention is a relatively large structure that provides the outward appearance of a traditional golf green. An actual golf green is a flat surface of carefully manicured grass having an appreciable area of up to several thousand square feet. The actual green will have a pin and hole located on its surface and possibly one of more hazards surrounding the surface. These hazards will include sand traps and water. The actual green is by its very nature expensive to build and maintain, and thus impractical at a driving range from a strictly economic standpoint.

The target green of the present invention has many of the attributes of an actual green, except on a scale significantly below that of the true green. In FIG. 1, the green surface, 10, is a small fraction of that normally associated with a true green, ranging from under 100 sq. ft. to several hundred sq. ft. in total surface area. The target green includes a traditional cup 20, (hole) with associated pin, 25 with flag (flagstick). One or more hazards are located on either side of the target green; this may include a white sand trap facsimile, 30 and a blue water trap facsimile, 40 wherein the color is attained, via paint or similar. A skirt, 50 is provided across the target green to direct driven golf balls to a common area.

Turning now to cross-section AA, the target green is presented in a cut-a-way section. As can be seen, the target green is configured at an incline defined by the dimensions D1 and D2. By increasing D1, the overall size of the target green is increased in appearance when viewed from a distance. A suitable D2/D1 ratio would be approximately 10 when viewed from a distance of 150 yards although this ratio may be changed to balance its appearance while providing a relatively flat landing surface. A minimum incline of 15 degrees is needed to cause the depth perception illusion.

System rigidity would be maintained by a network of support struts or braces. Alternatively, the target green can be constructed with an airtight material and slightly pressurized to retain its shape. Other methods of construction include closed cell foams or combinations of the above as may be dictated by the use of the system.

Continuing with FIG. 1 section AA, the surface of the green includes a shock absorbing cushion, 17 placed beneath the artificial turf, 15. The turf itself may be varied in height and density in a manner that facilitates the retention of properly hit golf shots duplicating the experience attained on an actual golf course. This would allow closest to the pin competitions at the range.

The above-described arrangement is merely illustrative of the principles of the present invention. Numerous modifications and adaptations thereof will be readily apparent to those skilled in the art without departing from the spirit and scope of the present invention.

What is claimed is:

1. An apparatus configured and constructed to give the outward appearance of a golf green comprising a portable shape defining means having an appearance of a standard size golf green when viewed from a distance of at least 100 yards for supporting a large, stationary and relatively flat continuous landing surface at an inclined angle of at least 15 degrees; a cup location placed on said landing surface with a flagstick extending from said cup upwards away from said landing surface a distance of at least three feet; and a landing surface cover having an outward appearance of a grass covered surface, wherein said inclined landing surface has a surface area appearance that is visually perceived as larger when viewed from a distance, wherein said shape defining means is constructed from an inflatable material.

2. The apparatus of claim 1 wherein said shape defining means includes a skirt to direct golf balls into a common area.

3. The apparatus of claim 1 further comprising attachable sections having the outward appearance of golf hazards selected from the group consisting of water and sand.

4. The apparatus of claim 2 wherein said shape defining means is constructed of sections combinable to form the entire green structure.

5. The apparatus of claim 4 wherein said landing surface cover is made of an artificial turf.

6. The apparatus of claim 5 wherein said artificial turf is separated from said landing surface by a energy absorbing sheet.

* * * * *